US008217870B2

(12) United States Patent
Woo et al.

(10) Patent No.: US 8,217,870 B2
(45) Date of Patent: Jul. 10, 2012

(54) METHOD AND APPARATUS FOR GENERATING GRADATION VOLTAGE FOR X-AXIS SYMMETRIC GAMMA INVERSION

(75) Inventors: Jae-hyuck Woo, Osan-si (KR); Jae-goo Lee, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 721 days.

(21) Appl. No.: 12/287,069

(22) Filed: Oct. 6, 2008

(65) Prior Publication Data

US 2009/0096731 A1 Apr. 16, 2009

(30) Foreign Application Priority Data

Oct. 12, 2007 (KR) ..... 10-2007-0103171

(51) Int. Cl.
*G09G 3/30* (2006.01)

(52) U.S. Cl. ..... 345/87

(58) Field of Classification Search ..... 345/77, 345/88, 89, 100, 690–693
See application file for complete search history.

(56) References Cited

U.S. PATENT DOCUMENTS 7,307,610 B2 12/2007 Sakaguchi
7,595,776 B2 * 9/2009 Hashimoto et al. ..... 345/76
2003/0201959 A1 10/2003 Sakaguchi
2006/0244692 A1 11/2006 Yoo

FOREIGN PATENT DOCUMENTS

| | | |
|---|---|---|
| JP | 2002-328653 | 11/2002 |
| JP | 2003-316333 | 11/2003 |
| JP | 2006-276114 | 10/2006 |
| KR | 10-0626077 | 9/2006 |

* cited by examiner

*Primary Examiner* — Alexander Eisen
*Assistant Examiner* — Robin Mishler
(74) *Attorney, Agent, or Firm* — Onello & Mello, LLP

(57) ABSTRACT

A method and apparatus for generating gradation voltages are provided. Maximum and minimum reference voltages are selected from a distribution of voltages ranging from a first source voltage to a second source voltage. The maximum reference voltage is selected as a $1^{st}$ gradation voltage and the minimum reference voltage is selected as an $N^{th}$ gradation voltage, or vice versa, in response to an inversion control signal, where N is a natural number. First to $M^{th}$ gamma voltages are selected from among a plurality of voltages generated by a voltage distribution between the $1^{st}$ gradation voltage and the $N^{th}$ gradation voltage. Second to $(N-1)^{th}$ gradation voltages are generated from a voltage distribution between the $1^{st}$ gradation voltage and the $N^{th}$ gradation voltage, using the $1^{st}$ gamma voltage to the $M^{th}$ gamma voltage, where M is a natural number.

20 Claims, 10 Drawing Sheets

METHOD AND APPARATUS FOR GENERATING GRADATION VOLTAGE FOR X-AXIS SYMMETRIC GAMMA INVERSION

CROSS-REFERENCE TO RELATED PATENT APPLICATION

This application claims the benefit of Korean Patent Application No. 10-2007-0103171, filed on Oct. 12, 2007, in the Korean Intellectual Property Office, the disclosure of which is incorporated herein in its entirety by reference.

FIELD OF THE INVENTION

The present invention relates to a method and apparatus for generating a gradation voltage, and more particularly, to a method and apparatus for generating a gradation voltage which implements gamma inversion as an X-axis symmetric type.

BACKGROUND

In general, an image sensor or a display panel has its intrinsic gamma properties that need to be considered in a display system including the image sensor or the display panel, and described with reference to FIGS. 1, 2A, 2B, 2C and 2D.

FIG. 1 is a block diagram illustrating a display system including a liquid crystal display (LCD) panel 150.

The display system illustrated in FIG. 1 includes a controller 110, a source driver 120, a gradation voltage generator 130, a gate driver 140 and the LCD panel 150. In FIG. 1, the source driver 120 includes a decoder DEC and a buffer BUF. Although not illustrated in FIG. 1, the gradation voltage generator 130 may be included inside the source driver 120.

The decoder DEC receives input of a plurality of gradation voltages V<0> to V<255> generated in the gradation voltage generator 130. The decoder DEC further outputs, from among the gradation voltages V<0> to V<255>, a gradation voltage corresponding to display data DATA as a display data voltage V_data that is then applied to the LCD panel 150 through the buffer BUF. The brightness of the LCD panel 150 (referred to as B_panel) corresponds to the display data voltage V_data.

FIGS. 2A and 2D are graphs each illustrating an interrelationship between the display data DATA and the display data voltage V_data, and FIGS. 2B and 2C are graphs each illustrating an interrelationship between the display data voltage V_data and the brightness of the LCD panel B_panel. In FIGS. 2A through 2D, <0> to <255> each indicate gradation.

For example, it will be considered that a gamma curve of the LCD panel 150 illustrated FIG. 1 is like the one of FIG. 2B. As illustrated in FIG. 2A, when display data voltages V_data<0> to V_data<255> having the same voltage distance ($\Delta V1=\Delta V2$) are generated in response to display data DATA <0> to DATA <255> of the gradation, and the display data voltages V_data<0> to V_data<255> having the same voltage distance $\Delta V1=\Delta V2$ are applied to the LCD panel 150, it is difficult to expect a linear brightness output, as illustrated in FIG. 2B.

For the linear brightness output illustrated in FIG. 2C, the voltage distance $\Delta V$ of the display data voltages V_data<0> to V_data<255> needs to be adjusted by the gradation voltage generator 130. That is, the gradation voltage generator 130 adjusts a voltage level of each of the gradation voltages V<0> to V<255>, so that the interrelationship between the display data DATA and the display data voltage V_data is like that of FIG. 2D. Accordingly, the display system is realized with proper gamma properties by adjusting each voltage level of each of the gradation voltages V<0> to V<255>. Also, not all display panels pursue the linear brightness output. In some case, the voltage levels of the gradation voltages V<0> to V<255> may be adjusted to delicately display the gradation of a specific portion.

To prevent the deterioration of a liquid crystal in the driving of the LCD panel 150, an inversion driving method is used during which the display data voltage V_data is applied so that an alignment direction of the liquid crystal changes per predetermined period. The inversion driving method can be classified as one of a frame inversion type, a line inversion type, a column inversion type, and a dot inversion type, depending on the set up of a pixel group that is being simultaneously inverted. Furthermore, the inversion driving method can be classified as a Y-axial symmetric type and an X-axis symmetric type, depending on whether the display data DATA or the gradation voltages V<0> to V<255> are being inverted.

The gradation voltage generator 130 included in the display system needs to generate the gradation voltages <0> to V<255> while considering the aforementioned gamma properties and inversion driving.

SUMMARY OF THE INVENTION

The present invention provides a method and apparatus for generating gradation voltages which implements gamma inversion as an X-axis symmetric type.

According to an aspect of the present invention, there is provided an apparatus for generating a gradation voltage, comprising a maximum/minimum selection unit configured to output a voltage corresponding to a maximum selection signal as a maximum reference voltage and a voltage corresponding to a minimum selection signal as a minimum reference voltage, from a distribution of voltages ranging from a first source voltage to a second source voltage; a first selector configured to output the maximum reference voltage or the minimum reference voltage as a $1^{st}$ gradation voltage, in response to an inversion control signal; a second selector configured to output the minimum reference voltage or the maximum reference voltage as an $N^{th}$ gradation voltage, in response to the inversion control signal, where N is a natural number; and a gamma control unit configured to select, from among a plurality of voltages in a voltage distribution between the $1^{st}$ gradation voltage and the $N^{th}$ gradation voltage, voltages corresponding to a $1^{st}$ gamma selection signal to an $M^{th}$ gamma selection signal, respectively, as a $1^{st}$ gamma voltage to an $M^{th}$ gamma voltage, where M is a natural number, and generate a $2^{nd}$ gradation voltage to an $(N-1)^{th}$ gradation voltage from the $1^{st}$ gamma voltage to the $M^{th}$ gamma voltage.

The maximum/minimum selection unit can comprise a source division unit configured to generate a plurality of voltages from a voltage distribution ranging from the first source voltage to the second source voltage; a maximum selector configured to output the voltage corresponding to the maximum selection signal as the maximum reference voltage, from among voltages ranging from the first source voltage to a middle voltage of the voltage distribution; and a minimum selector configured to output the voltage corresponding to the minimum selection signal as the minimum reference voltage, from among voltages ranging from the middle voltage to the first source voltage.

The apparatus can further comprise a maximum adjustment register configured to output the maximum selection signal to the maximum selector through a first level shifter; and a minimum adjustment register configured to output the minimum selection signal to the minimum selector through a second level shifter.

The apparatus can further comprise an X-axis symmetry register configured to outputting the inversion control signal to the first selector and the second selector through a level shifter.

When a logic level of the inversion control signal is at a first level, the first selector can output the maximum reference voltage as the $1^{st}$ gradation voltage, and the second selector can output the minimum reference voltage as the $N_{th}$ gradation voltage.

When a logic level of the inversion control signal is at a second level, the first selector can output the minimum reference voltage as the $1^{st}$ gradation voltage, and the second selector can output the maximum reference voltage as the $N_{th}$ gradation voltage.

The gamma control unit can comprise: a $1^{st}$ gradation buffer configured to buffer and output the $1^{st}$ gradation voltage output from the first selector; and a $N_{th}$ gradation buffer configured to buffer and output the $N^{th}$ gradation voltage output from the second selector.

The gamma control unit can comprise a gamma division unit configured to generate the plurality of voltages through the voltage distribution between the $1^{st}$ gradation voltage and the $N_{th}$ gradation voltage; and $1^{st}$ to $M^{th}$ gamma selectors configured to output, from the plurality of voltages, voltages corresponding to the $1^{st}$ to $M^{th}$ gamma selection signals as $1^{st}$ to $M^{th}$ gamma voltages, respectively.

The apparatus can further comprise a gamma adjustment register configured to output each of the $1^{st}$ gamma selection signal to the $M^{th}$ gamma selection signal, respectively, to the $1^{st}$ gamma selector to the $M^{th}$ gamma selector, through respective level shifters.

The gamma control unit can further comprise: $1^{st}$ to $M^{th}$ gamma buffers configured to buffer and output the $1^{st}$ to $M^{th}$ gamma voltages output from the $1^{st}$ to $M^{th}$ gamma selectors, respectively.

The gamma control unit may further comprise a gradation division unit configured to generate the $2^{nd}$ gradation voltage to the $(N-1)^{th}$ gradation voltage through a voltage distribution between the $1^{st}$ gamma voltage to the $M^{th}$ gamma voltage.

In the apparatus: an $m^{th}$ gamma buffer can output an $m^{th}$ gamma voltage as an $n^{th}$ gradation voltage; an $(m+1)^{th}$ gamma buffer can output an $(m+1)^{th}$ gamma voltage as an $(n+p)^{th}$ gradation voltage; and an $(m+2)^{th}$ gamma buffer can output an $(m+2)^{th}$ gamma voltage as an $(n+p+q)^{th}$ gradation voltage, where m, n, p, and q are natural numbers, and m=1 to M and n=1 to N.

The gradation division unit can be configured to generate an $(n+1)^{th}$ gradation voltage to an $(n+p-1)^{th}$ gradation voltage through a voltage distribution between the $n^{th}$ gradation voltage and the $(n+p)^{th}$ gradation voltage, and to generate an $(n+p+1)^{th}$ gradation voltage to an $(n+p+q-1)^{th}$ gradation voltage through a voltage distribution between the $(n+p)^{th}$ gradation voltage and the $(n+p+q)^{th}$ gradation voltage.

The $$\left(\frac{M+1}{2}\right)^{th}$$

gamma voltage being output from the $$\left(\frac{M+1}{2}\right)^{th}$$

gamma selector to the $$\left(\frac{M+1}{2}\right)^{th}$$

gamma buffer may not be used as the gradation voltage.

The gamma control unit can further comprise an inflection point adjustment switch configured to adjust a connection point between an $m^{th}$ gamma buffer and the gradation division unit, in response to an inflection point adjustment signal, where m is a natural number that equals 1 to M.

The apparatus may further comprise an inflection point adjustment register configured to output the inflection point adjustment signal to the inflection point adjustment switch through a level shifter.

According to another aspect of the present invention, there is provided a method of generating a gradation voltage, comprising selecting a maximum reference voltage and a minimum reference voltage, from a distribution of voltages ranging from a first source voltage to a second source voltage; selecting the maximum reference voltage as a $1^{st}$ gradation voltage and the minimum reference voltage as an $N_{th}$ gradation voltage, or selecting the minimum reference voltage as the $1^{st}$ gradation voltage and the maximum reference voltage as the $N_{th}$ gradation voltage, in response to an inversion control signal, where N is a natural number; selecting a $1^{st}$ gamma voltage to an $M^{th}$ gamma voltage, in a voltage distribution between the $1^{st}$ gradation voltage and the $N_{th}$ gradation voltage, where M is a natural number; and generating a $2^{nd}$ gradation voltage to an $(N-1)^{th}$ gradation voltage by a voltage distribution between the 1st gradation voltage, the $1^{st}$ gamma voltage to the $M^{th}$ gamma voltage, and the $N^{th}$ gradation voltage.

When a logic level of the inversion control signal is at a first level, the maximum reference voltage can be selected as the $1^{st}$ gradation voltage and the minimum reference voltage is selected as the $N^{th}$ gradation voltage.

When a logic level of the inversion control signal is at a second level, the minimum reference voltage can be selected as the $1^{st}$ gradation voltage and the maximum reference voltage is selected as the $N^{th}$ gradation voltage.

When an $m^{th}$ gamma voltage is output as an $n^{th}$ gradation voltage and an $(m+i)^{th}$ gamma voltage is output as an $(n+p)^{th}$ gradation voltage and an $(m+_2)^{th}$ gamma voltage is output as an $(n+p+q)^{th}$ gradation voltage, an $(n+i)^{th}$ gradation voltage to an $(n+p-1)^{th}$ gradation voltage can be generated through a voltage distribution between the $n^{th}$ gradation voltage and the $(n+p)^{th}$ gradation voltage, and an $(n+p+i)^{th}$ gradation voltage to an $(n+p+q-1)^{th}$ gradation voltage can be generated through a voltage distribution between the $(n+p)^{th}$ gradation voltage and the $(n+p+q)^{th}$ gradation voltage, where m, n, p, and q are natural numbers and m=1 to M and n=1 to N.

BRIEF DESCRIPTION OF THE DRAWINGS

The various features and advantages of the present invention will become more apparent by describing in detail exemplary embodiments in accordance therewith, with reference to the attached drawings, in which.

DETAILED DESCRIPTION OF THE PREFERRED EMBODIMENTS

Hereinafter, aspects of the present invention will be described by explaining illustrative embodiments in accordance therewith, with reference to the attached drawings. While describing these embodiments, detailed descriptions of well-known items, functions, or configurations are typically omitted for conciseness.

Before the present invention will be explained, FIGS. 3A and 3B will be described.

Figure 3A:
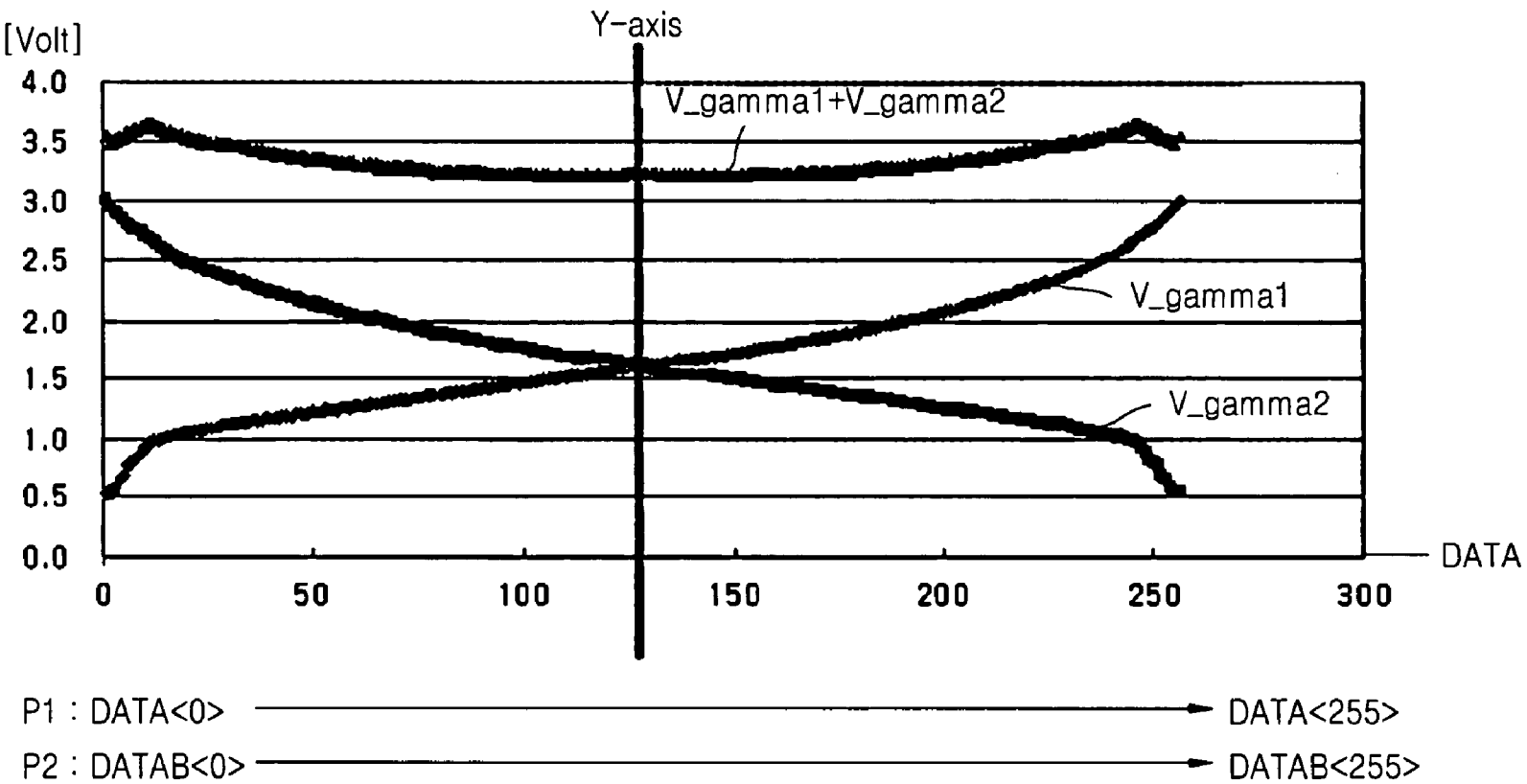
FIG. 3A illustrates Y-axis symmetric gamma inversion and FIG. 3B illustrates X-axis symmetric gamma inversion.
Figure 3B:
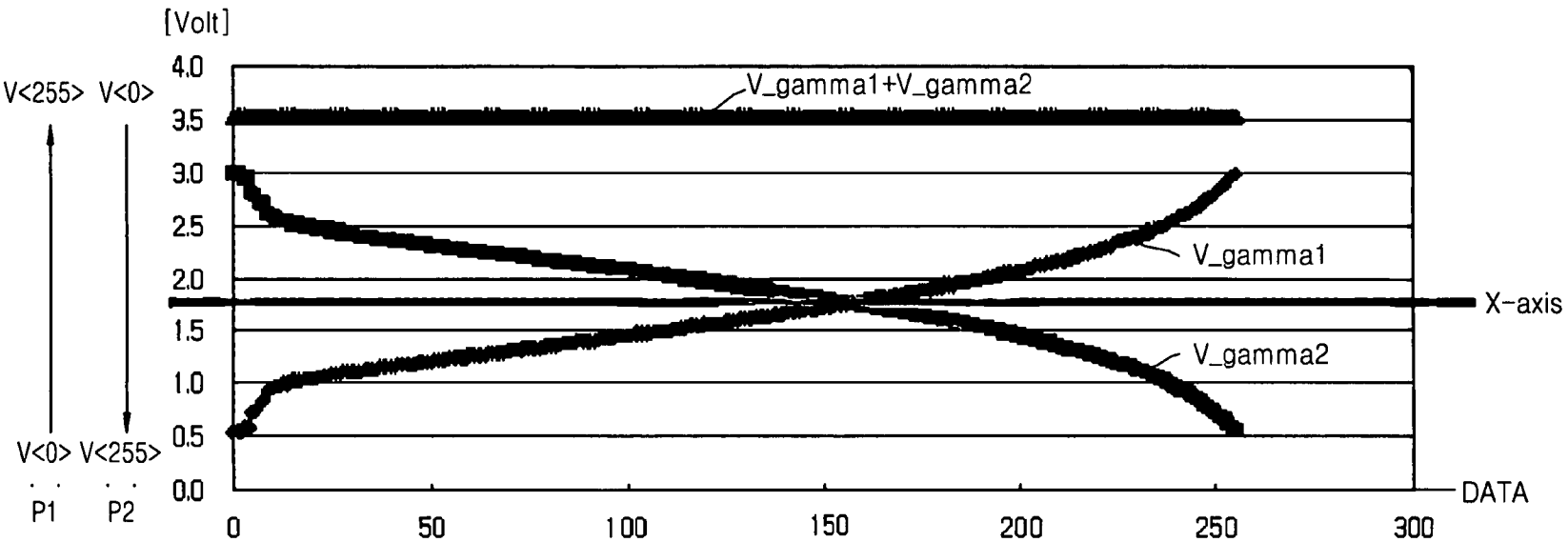

FIG. 3A illustrates Y-axis symmetric gamma inversion and FIG. 3B illustrates X-axis symmetric gamma inversion.

In FIG. 3A, gamma inversion is implemented as a Y-axis symmetric type. In FIG. 3A, gamma curves V_gamma1 and V_gamma2 are each symmetric with respect to a Y-axis. In a first part P1, the display data DATA is mapped in the gamma curve V_gamma1. In a second part P2, the display data DATA is inverted and the resulting inverted display data DATAB is mapped in the gamma curve V_gamma1. Consequently, in the second part P2, there is an effect of mapping the display data DATA in the gamma curve V_gamma2. Following the operation in the second part P2, the operation in the first part P1 is implemented. Accordingly, the operation in the first part P1 and the operation in the second part P2 repeat in an alternating manner, to implement the gamma inversion.

For example, when a display data sequence is DATA<0>, DATA<0>, DATA<0>, DATA<0>, DATA<0> and the display data sequence is inverted in the second part P2 only, the display data sequence becomes DATA<0>, DATA<255>, DATA<0>, DATA<255>, DATA<0>. When the display data sequence of DATA<0>, DATA<255>, DATA<0>, DATA<255>, DATA<0>, instead of the display data sequence of DATA<0>, DATA<0>, DATA<0>, DATA<0>, DATA<0>, is input to the decoder DEC of FIG. 1, the gamma inversion can be implemented as the Y-axis symmetric type. However, in the Y-axis symmetric gamma inversion, the gradation voltages V<0> to V<255> being output from the gradation voltage generator 130 to the decoder DEC are not inverted. That is, the gradation voltage generator 130 outputs the gradation voltages V<0> to V<255> to the decoder DEC according to the gamma curve V_gamma1, irrelevant of the first part P1 and the second part P2.

In FIG. 3B, gamma inversion is implemented as an X-axis symmetric type. In FIG. 3B, gamma curves V_gamma1 and V_gamma2 are symmetric with respect to an X-axis. The gradation voltage generator 130 outputs the gradation voltages V<0> to V<225> to the decoder DEC according to the gamma curve V_gamma1 in the first part P1. Thus, in the first part P1, the display data DATA is mapped in the gamma curve V_gamma1. The gradation voltage generator 130 outputs the gradation voltages V<225> to V<0> to the decoder DEC according to the gamma curve V_gamma2 in the second part P2. Thus, in the second part P2, the display data DATA is mapped in the gamma curve V_gamma2. Accordingly, in the X-axis symmetric type gamma inversion, the display data DATA is not inverted in the second part P2 and the gradation voltages V<0> to V<255> are inverted in the second part P2.

Figure 1:
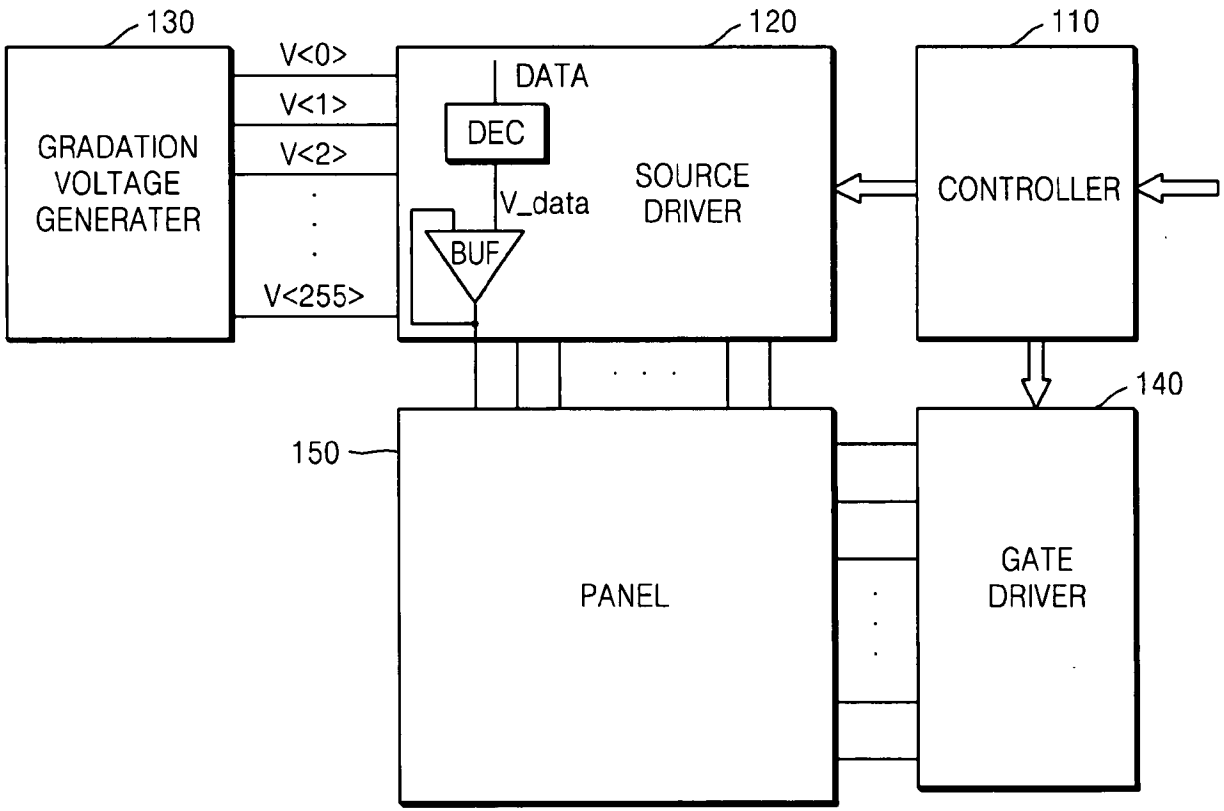
FIG. 1 (RELATED ART)
FIG. 1 is a block diagram of a prior art display system including a liquid crystal display (LCD) panel.
Figure 2A:
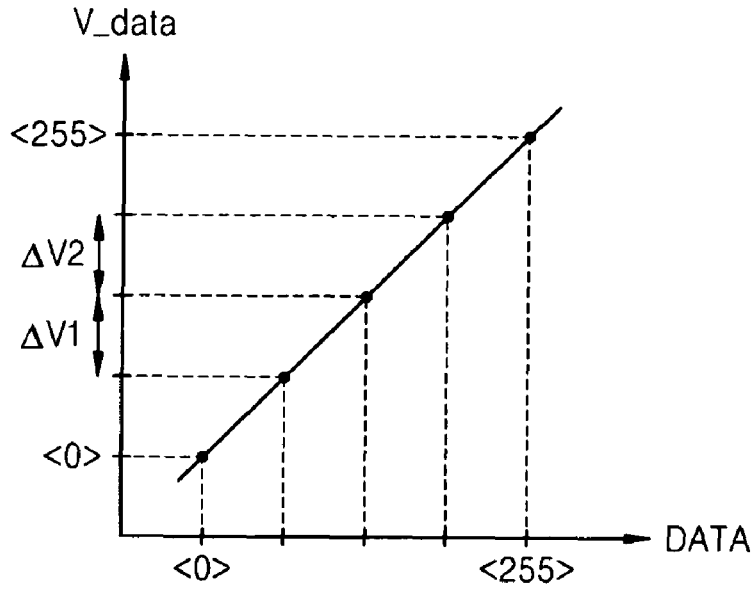
FIG. 2A (RELATED ART)
FIGS. 2A and 2D each illustrate interrelationships between a display data DATA and a display data voltage V_data in prior art apparatuses, and FIGS. 2B and 2C each illustrate the interrelationships between the display data voltage V_data and the brightness of the LCD panel B_panel.
Figure 2B:
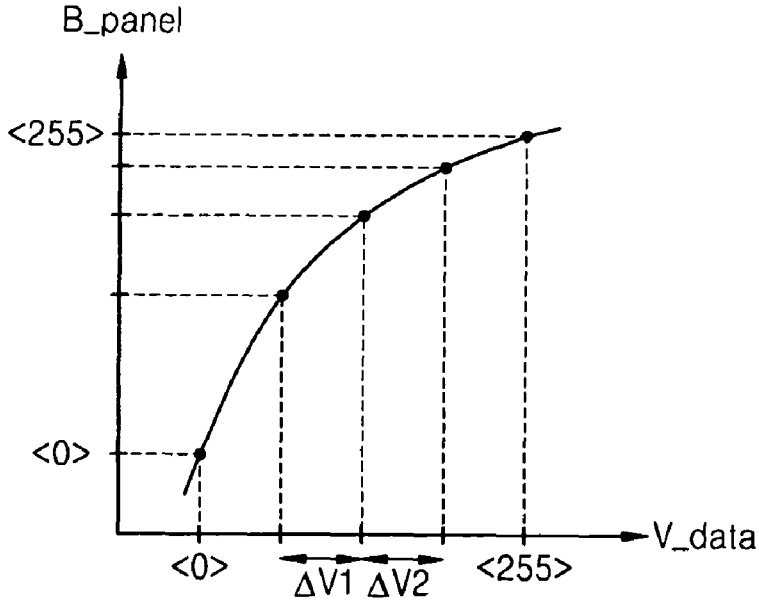
FIG. 2B (RELATED ART)
Figure 2C:
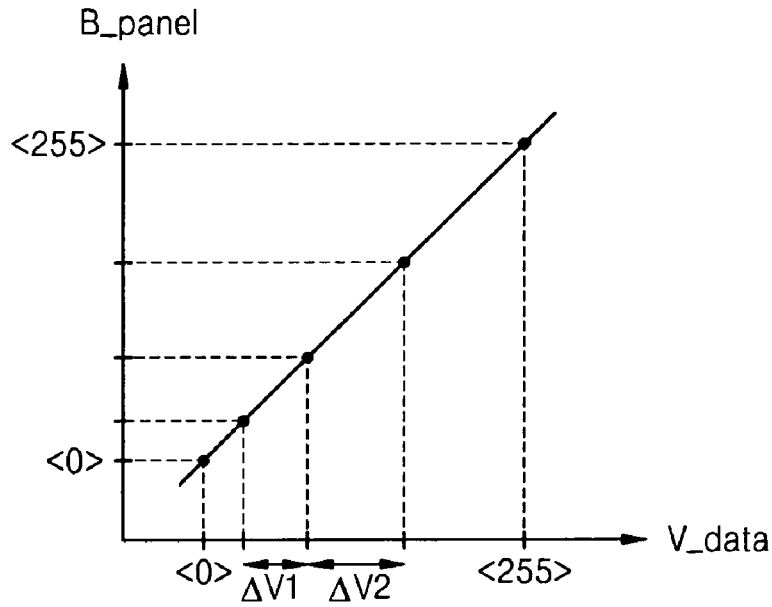
FIG. 2C (RELATED ART)
Figure 2D:
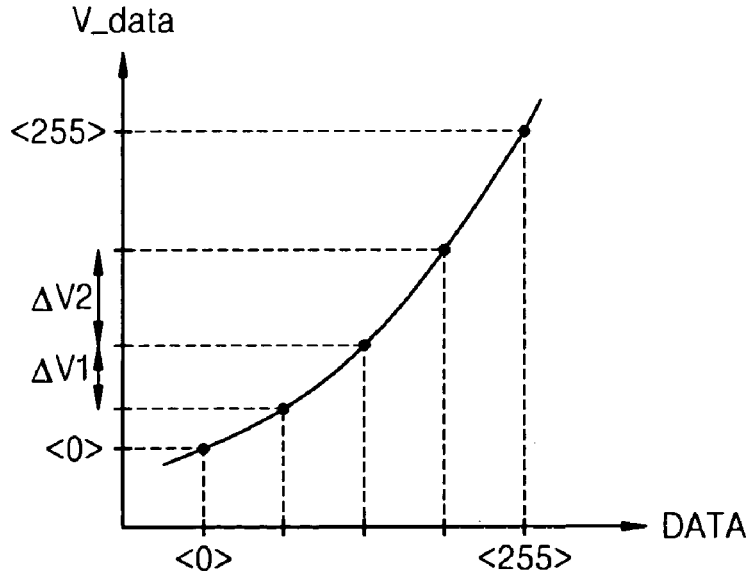
FIG. 2D (RELATED ART)

For example, when the display data sequence of DATA<0>, DATA<0>, DATA<0>, DATA<0>, DATA<0> is input to the decoder DEC of FIG. 1, the decoder DEC outputs, as the display data voltage V_data, the gradation voltage V<0> in a first one of the first parts P1, the gradation voltage V<255> in a first one of the second parts P2, the gradation voltage V<0> in a second one of the first parts P1, the gradation voltage V<255> in a second one of the second parts P2, and the gradation voltage V<0> in a third one of the first parts P1.

As illustrated in FIG. 3B, in the X-axis symmetric type gamma inversion, V_gamma1+V_gamma2 is maintained in a constant value (e.g., about 3.5 Volts in FIG. 3B). However, as illustrated in FIG. 3A, in the Y-axial symmetric type gamma inversion, V_gamma1+V_gamma2 is not maintained at a constant value. To secure an accurate gamma inversion, V_gamma1+V_gamma2 may be maintained as a constant value. Thus, when the Y-axis symmetric type of gamma inversion is applied, an additional gamma correction operation can be implemented so that the Y-axis symmetric type gamma inversion is proximate to the X-axis symmetric type. In this case, a complicated gamma correction operation is needed to accurately maintain V_gamma1+V_gamma2 at a substantially constant value.

Figure 4:
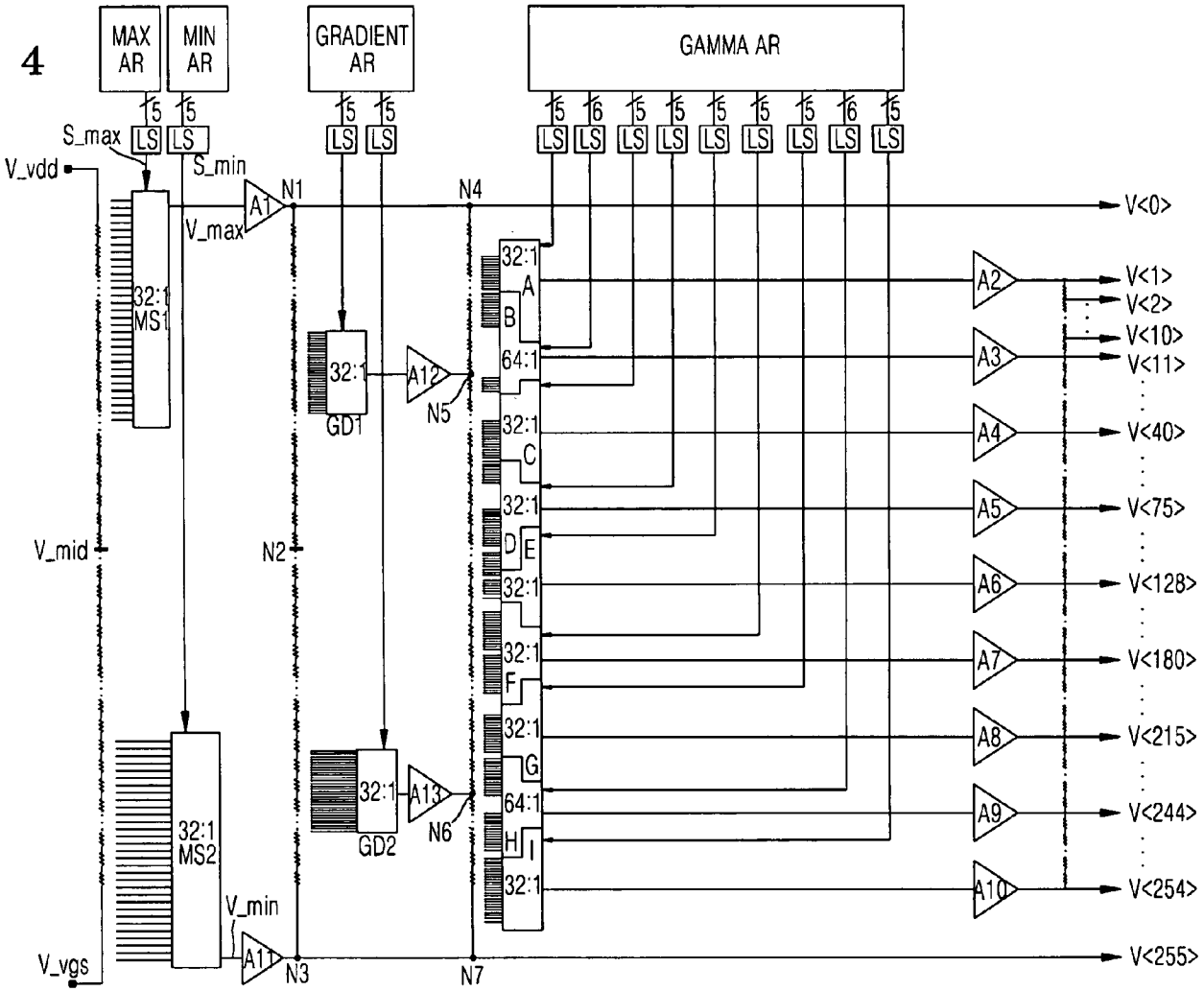
FIG. 4 illustrates a gradation voltage generator.

FIG. 4 illustrates a gradation voltage generator. For example, the gradation voltage generator of FIG. 4 may be operated in place of the gradation voltage generator 130 of FIG. 1.

In FIG. 4, a maximum selector MS1 selects any one of the voltages, from a first source voltage V_vdd to a middle voltage V_mid, as a maximum reference voltage V_max. A maximum adjustment register MAX AR outputs a maximum selection signal S_max to the maximum selector MS1 through a level shifter LS, to control the selection of the maximum reference voltage V_max. A buffer A1 outputs the maximum reference voltage V_max, which is output from the maximum selector MS1, as a $1^{st}$ gradation voltage V<0>. In FIG. 4, a minimum selector MS2 selects any one of the voltages, from the middle voltage V_mid to a second source voltage V_vgs, as a minimum reference voltage V_min. A minimum adjustment register MIN AR outputs a minimum selection signal S_min to the minimum selector MS2 through a level shifter LS, to control the selection of the minimum reference voltage V_min. A buffer A11 outputs the minimum reference voltage V_min, which is output from the minimum selector MS2, as a $256^{th}$ gradation voltage V<255>.

In FIG. 4, a first gradient selector GD1 outputs any one of a plurality of voltages, generated by the voltage distribution between nodes N1 and N2, to a buffer A12. A second gradient selector GD2 outputs any one of a plurality of voltages, generated by the voltage distribution between nodes N2 and N3, to a buffer A13. A gradient adjustment register GRADIENT AR controls the first gradient selector GD1 and the second gradient selector GD2, to adjust the gradient of a gamma curve.

A plurality of selectors A, B, C, D, E, F, G, H and I, controlled by a gamma adjustment register GAMMA AR, each select any one of a plurality of voltages generated by the voltage distribution between nodes N4, N5, N6 and N7. The gamma adjustment register GAMMA AR controls the selection operation of the selectors A, B, C, D, E, F, G, H and I, to determine a gamma curve.

A buffer A2 outputs a voltage being output from the selector A as a $2^{nd}$ gradation voltage V<1>. A buffer A3 outputs a voltage being output from the selector B as a $12^{th}$ gradation voltage V<1>. As illustrated in FIG. 4, a $3^{rd}$ gradation voltage V<2> to an $11^{th}$ gradation voltage V<10> are generated by the voltage distribution between the $2^{nd}$ gradation voltage V<1> and the $12^{th}$ gradation voltage V<11>. One skilled in the art understands the operation of a buffer A4 to a buffer A10 and the generation of a $13^{th}$ gradation voltage V<12> to a $255^{th}$ gradation voltage V<254> will be consistent with that described above for gradation voltages V<1> through V<11>.

For example, when the gradation voltage generator of FIG. 4 generates the $12^{th}$ gradation voltage V<11>, the buffers A1, A12 and A3 are involved. Similarly, when the gradation voltage generator of FIG. 4 generates a $216^{th}$ gradation voltage V<215>, the buffers A11, A13 and A8 are involved. When an offset of each buffer is $\pm\Delta\epsilon$, the $2^{nd}$ to $255^{th}$ gradation voltages V<1> to V<254> generated by the gradation voltage generator of FIG. 4 have the offset of $\pm 3\Delta\epsilon$ (that is, 3 stages offset). Thus, it is required to reduce the offset included in the $2^{nd}$ to $255^{th}$ gradation voltages V<1> to V<254>.

When the gradient adjustment register GRADIENT AR adjusts the selection operation of the first gradient selector GD1 and second gradient selector GD2 to reset the gradient of the gamma curve, the voltage levels of the $2^{nd}$ gradation voltage V<1> through the $255^{th}$ gradation voltage V<254> are all changed. Considering this aspect, it is difficult for the gradation voltage generator of FIG. 4 to reset the gamma curve.

Figure 5:
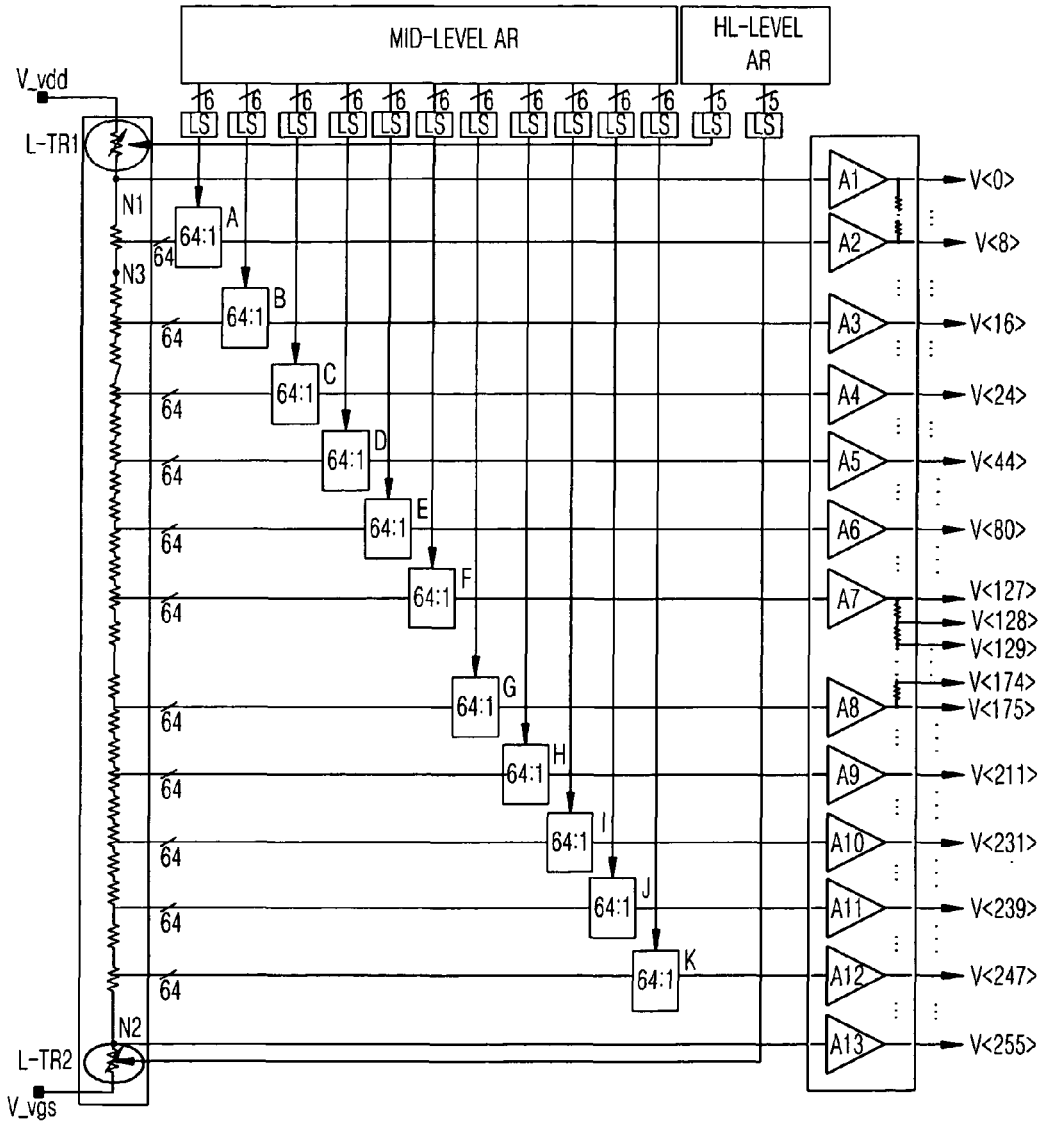
FIG. 5 illustrates another gradation voltage generator.

FIG. 5 illustrates another gradation voltage generator. The gradation voltage generator of FIG. 5 may be operated in place of the gradation voltage generator 130 of FIG. 1.

In FIG. 5, a first transistor L-TR1 connected to a first source voltage V_vdd determines a voltage of a node N1, in response to a control signal from a high/low level adjustment register HL-LEVEL AR. The voltage of the node N1 is output through a buffer A1 as a $1^{st}$ gradation voltage V<0>. A second transistor L-TR2 connected to a second source voltage V_vgs determines a voltage of a node N2, in response to a control signal from the high/low level adjustment register HL-LEVEL AR. The voltage of the node N2 is output through a buffer A13 as a $256^{th}$ gradation voltage V<255>.

In FIG. 5, a selector A selects any one of sixty-four (64) voltages generated by the voltage distribution between the node N1 and a node N3. The voltage being output from the selector A is output through a buffer A2 as a gth gradation voltage V<8>. A middle level adjustment register MID-LEVEL AR outputs a 6-bit control signal to the selector A through a level shifter LS, to control the selection operation of the selector A. A $2^{nd}$ gradation voltage V<1> to an $8^{th}$ gradation voltage V<7> are generated by the voltage distribution between the $1^{st}$ gradation voltage V<0> and the $9^{th}$ gradation voltage V<8>.

Since one skilled in the art, given the benefit of the above description, understands the operation of selectors B through K, the operation of buffers A3 through A12 and the generation of a $10^{th}$ gradation voltage V<9> to a $255^{th}$ gradation voltage V<254> will not be described in detail herein.

In FIG. 5, when an offset of each of the buffers A1 to A13 is $\pm\Delta\epsilon$, the $1^{st}$ to $256^{th}$ gradation voltages V<0> to V<255> generated by the gradation voltage generator of FIG. 5 have the offset of $\pm\Delta\epsilon$ (that is, a 1 stage offset). Thus, the gradation voltage generator of FIG. 5 can be regarded as better than the gradation voltage generator of FIG. 4 in terms of offset. However, in the gradation voltage generator of FIG. 5, since the large first and second transistors L-TR1 and L-TR2 are used to adjust the voltage levels of the $1^{st}$ gradation voltage V<0> and the $256^{th}$ gradation voltage V<255>, the gradation voltage generator of FIG. 5 has a drawback in terms of chip size.

Figure 6:
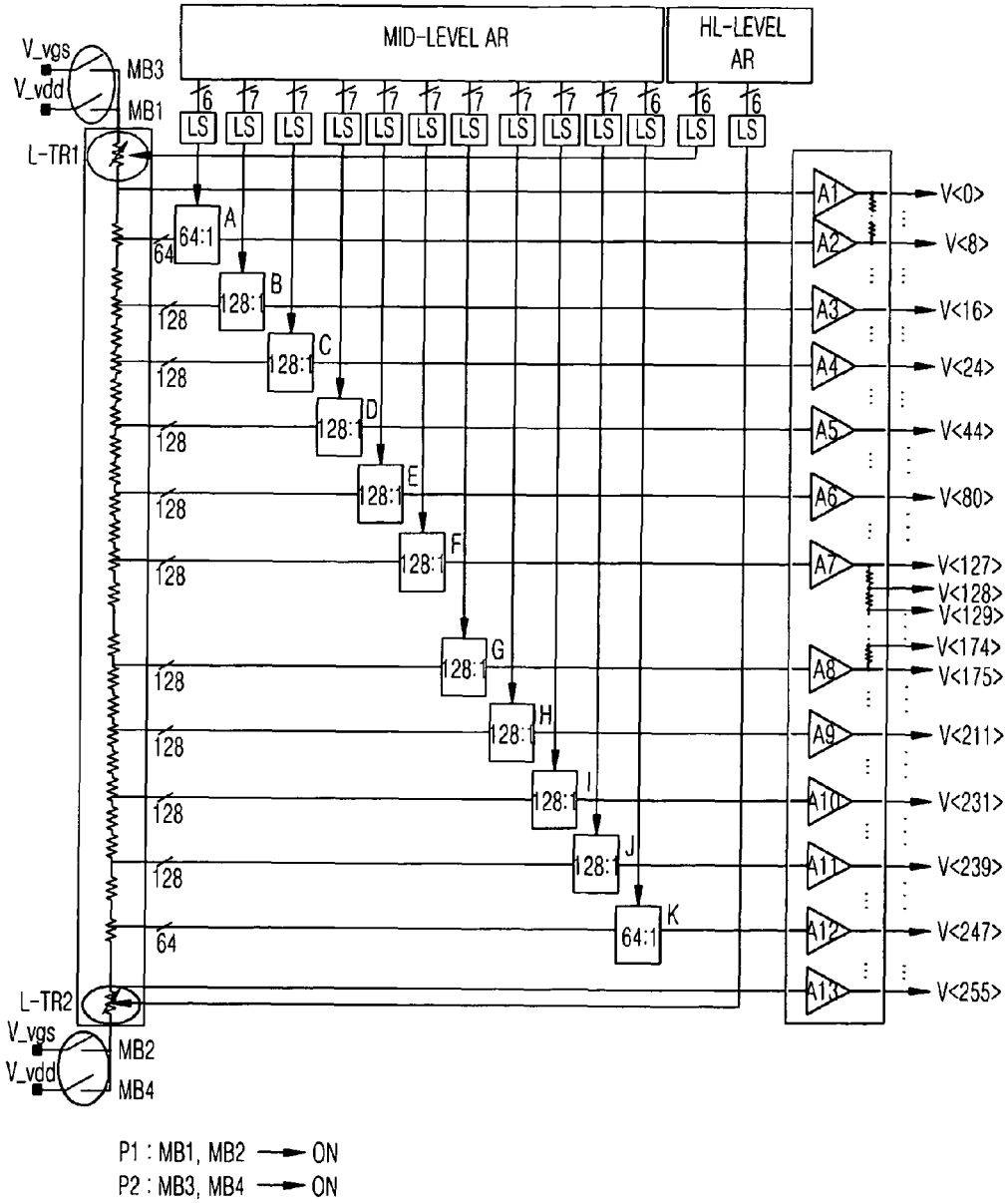
FIG. 6 illustrates another gradation voltage generator.

FIG. 6 illustrates another gradation voltage generator. The gradation voltage generator of FIG. 6 may be operated in place of the gradation voltage generator 130 of FIG. 1. Since the gradation voltage generator of FIG. 6 is similar to that of FIG. 5, the former will be described by focusing on the differences there between.

In FIG. 5, the selector B outputs, from among the sixty-four (64) voltages, a voltage corresponding to the 6-bit control signal to the buffer A3. In comparison with this, in FIG. 6, a selector B outputs, from among the one hundred twenty-eight (128) voltages, a voltage corresponding to a 7-bit control signal to a buffer A3. The selectors C through J are implemented in the same manner.

The biggest difference between the gradation voltage generators of FIGS. 5 and 6 is that the gradation voltage generator of FIG. 6 is capable of supporting an X-axis symmetric gamma inversion, unlike the one of FIG. 5. The gradation voltage generator of FIG. 5 or FIG. 4 does not include any units for inverting the $1^{st}$ to 256th gradation voltages V<0> to V<255> but the one of FIG. 6 is capable of inverting the $1^{st}$ to $256^{th}$ gradation voltages V<0> to V<255> by using first, second, third and fourth inversion transistors MB1, MB2, MB3 and MB4. That is, in a first part P1, the first inversion transistor MB1 and the second inversion transistor MB2 are turned on to generate the $1^{st}$ to $256^{th}$ gradation voltages V<0> to V<255>, and in a second part P2, the third inversion transistor MB3 and the fourth inversion transistor MB4 are turned on to generate the $1^{st}$ to $256^{th}$ gradation voltages V<0> to V<255>. Accordingly, the X-axis symmetric gamma inversion is supported by alternating and repeating the operation in the first part P1 and the operation in the second part P2. However, the gradation voltage generator of FIG. 6 also has a drawback in terms of chip size because the gradation voltage generator uses the large transistors L-TR1, L-TR2, and first to fourth transistors MB1, MB2, MB3 and MB4.

Figure 7:
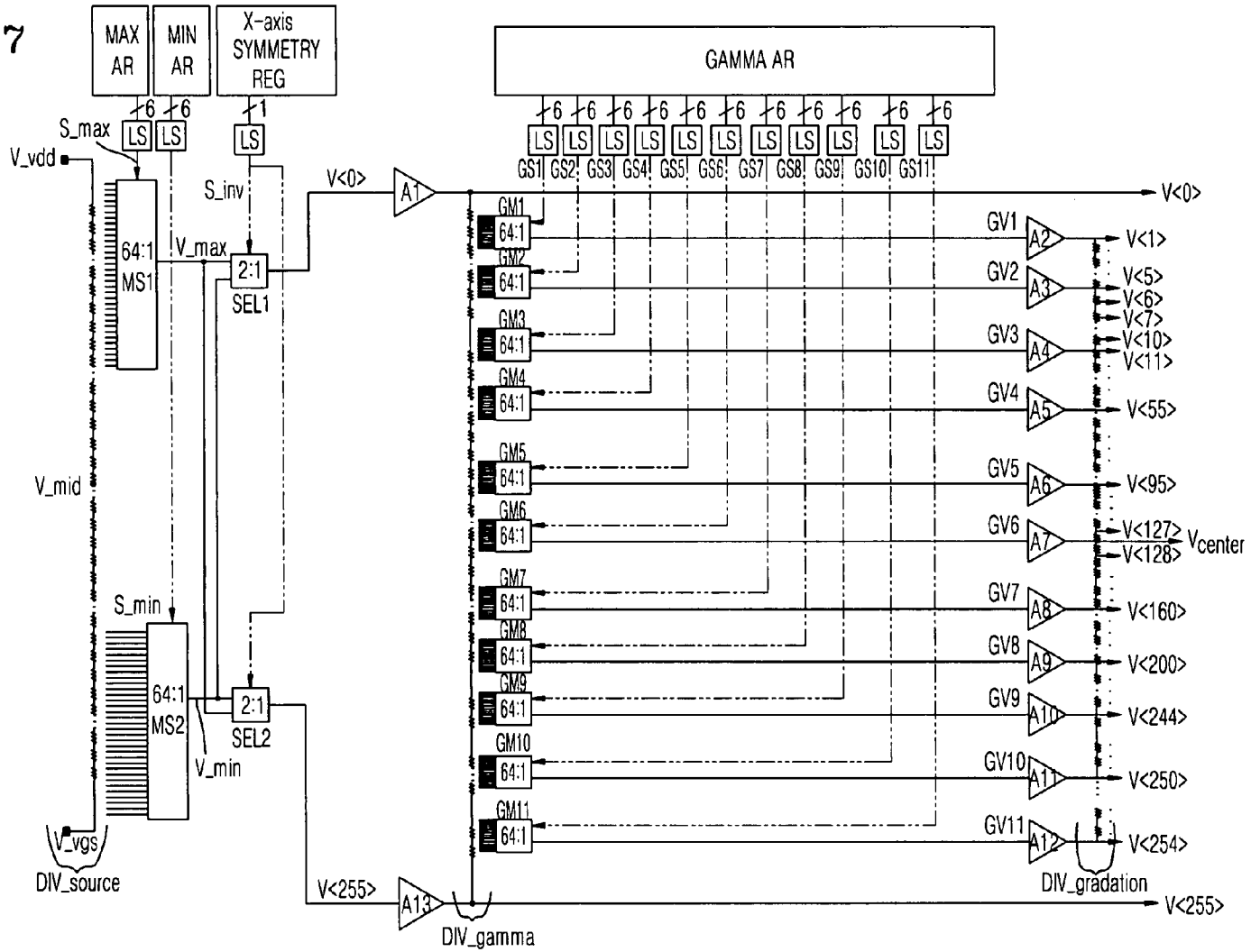
FIG. 7 illustrates an embodiment of an apparatus for generating a gradation voltage, according to aspects of the present invention.

FIG. 7 illustrates an embodiment of an apparatus for generating a gradation voltage, according to an aspect of the present invention.

The apparatus for generating the gradation voltage of FIG. 7 comprises: a maximum/minimum selection unit including a source division unit DIV_source, a maximum selector MS1 and a minimum selector MS2; a maximum adjustment register MAX AR; a minimum adjustment register MIN AR; a first selector SEL1; a second selector SEL2; an X-axis symmetry register X-axis SYMMETRY REG; a gamma control unit including gradation buffers A1 and A13, a gamma division unit DIV_gamma, gamma selectors GM1 to GM11, gamma buffers A2 to A12 and a gradation division unit DIV_gradation; a gamma adjustment register GAMMA AR; and a plurality of level shifters LS.

The maximum/minimum selection unit, which comprises the source division unit DIV_source, the maximum selector MS1 and the minimum selector MS2, outputs a voltage corresponding to a maximum selection signal S_max as a maximum reference voltage V_max and outputs, among the voltages from a first source voltage V_vdd to a second source voltage V_vgs, a voltage corresponding to a minimum selection signal S_min as a minimum reference voltage V_min. Specifically, the source division unit DIV_source generates a plurality of voltages by voltage distribution between a first source voltage V_vdd and a second source voltage V_vgs.

The maximum selector MS1 outputs, among the voltages from the first source voltage V_vdd to a middle voltage V_mid, a voltage corresponding to the maximum selection signal S-max as the maximum reference voltage V_max. The minimum selector MS2 outputs, among the voltages from the middle voltage V_mid to the second source voltage V_vgs, the voltage corresponding to the minimum selection signal S_min as the minimum reference voltage V_min.

The maximum adjustment register MAX AR outputs the maximum selection signal S_max to the maximum selector MS1 through the level shifter LS, to control the selection operation of the maximum selector MS1. The minimum adjustment register MIN AR outputs the minimum selection signal S_min to the minimum selector MS2 through a level shifter LS, to control the selection operation of the minimum selector MS2.

The first selector SEL1 outputs the maximum reference voltage V_max or the minimum reference voltage V_min as a $1^{st}$ gradation voltage V<0>, in response to an inversion control signal S_inv. The second selector SEL2 outputs the minimum reference voltage V_min or the maximum reference voltage V_max as a 256th gradation voltage V<255>, in response to the inversion control signal S_inv. The X-axis symmetry register X-axis SYMMETRY REG outputs the inversion control signal S_inv to the first selector SEL1 and the second selector SEL2 through the level shifter LS, to control the selection operation of the first and second selectors SEL1 and SEL2.

An operation section of the apparatus for generating the gradation voltage as illustrated in FIG. 7 can be divided as a first section and a second section. In the first section, a logic level of the inversion control signal S_inv is at a first level (for example, a high level), and in the second section, a logic level of the inversion control signal S_inv is at a second level (for example, a low level). Specifically, when the logic level of the inversion control signal S_inv is at the first level, the first selector SEL1 outputs the maximum reference voltage V_max as the $1^{st}$ gradation voltage V<0> and the second selector SEL2 outputs the minimum reference voltage V_min as the $256^{th}$ gradation voltage V<255>. Furthermore, when the logic level of the inversion control signal S_inv is at the second level, the first selector SEL1 outputs the minimum reference voltage V_min as the $1^{st}$ gradation voltage V<0> and the second selector SEL2 outputs the maximum reference voltage V_max as the $256^{th}$ gradation voltage V<255>. That is, the apparatus for generating the gradation voltage, illustrated in FIG. 7, repeats the operation in the first section and the operation in the second section alternately, thereby being capable of periodically inverting the $1^{st}$ gradation voltage V<0> and the $256^{th}$ gradation voltage V<255>.

The gamma control unit, which comprises the gradation buffers A1 and A13, the gamma division unit DIV_gamma, the gamma selectors GM1 to GM11, the gamma buffers A2 to A12, and the gradation division unit DIV_gradation, selects, from among the voltages generated by the voltage distribution between the $1^{st}$ gradation voltage V<0> and the $256^{th}$ gradation voltage V<255>, voltages each corresponding to a $1^{st}$ gamma selection signal GS1 to an $11^{th}$ gamma selection signal GS11, as a $1^{st}$ gamma voltage GV1 to an $11^{th}$ gamma voltage GV11 and generates a $2^{nd}$ gradation voltage V<1> to a $255^{th}$ gradation voltage V<254> from the $1^{st}$ gamma voltage GV1 to the $11^{th}$ gamma voltage GV11. FIG. 7 illustrates the apparatus for generating the gradation voltage comprising eleven (11) gamma selectors GM1 to GM11 and eleven (11) gamma buffers A2 to A12, but the present invention is not limited thereto and thus the number of selectors and gamma buffers may be varied in different embodiments.

The gradation buffer A1 buffers the $1^{st}$ gradation voltage V<0> being output from the first selector SEL1. The gradation buffer A13 buffers the 256th gradation voltage V<255> being output from the second selector SEL2. The gamma division unit DIV_gamma generates a plurality of voltages by the voltage distribution between the $1^{st}$ gradation voltage V<0> and the $256^{th}$ gradation voltage V<255>.

The gamma selector GM1 outputs a voltage, among a plurality of the voltages being input from the gamma division unit DIV_gamma, corresponding to a $1^{st}$ gamma selection signal GS1, as a $1^{st}$ gamma voltage GV1. The gamma buffer A2 buffers the $1^{st}$ gamma voltage GV1 being output from the gamma selector GM1 to output the $1^{st}$ gamma voltage GV1 as a $2^{nd}$ gradation voltage V<1>. The gamma selector GM2 outputs a voltage corresponding to a $2^{nd}$ gamma selection signal GS2, from among a plurality of the voltages being input from the gamma division unit DIV_gamma, as a $2^{nd}$ gamma voltage GV2. The gamma buffer A3 buffers the $2^{nd}$ gamma voltage GV2 being output from the $2^{nd}$ gamma selector GM2 to output the $2^{nd}$ gamma voltage GV2 as a $6^{th}$ gradation voltage V<5>.

One skilled in the art, having the benefit of this disclosure, would understand the operations of gamma selector GM3 to the gamma selector GM11, with reference to the operation of the gamma selector GM1 and the gamma selector GM2, as described above. Furthermore, one skilled in the art, having the benefit of this disclosure, would understand the operation of the gamma buffer A4 to the gamma buffer A12, with reference to the operation of the gamma buffer A2 and the gamma buffer A3. For example, when m, n, p and q are natural numbers, an $m^{th}$ gamma buffer outputs an $m^{th}$ gamma voltage, which is output from an $M^{th}$ gamma selector, as an $n^{th}$ gradation voltage, an $(m+1)^{th}$ gamma buffer outputs an $(m+1)^{th}$ gamma voltage, which is output from an $(m+1)^{th}$ gamma selector, as an $(n+p)^{th}$ gradation voltage, and an $(m+_2)^{th}$ gamma buffer outputs an $(m+2)^{th}$ gamma voltage, which is output from an $(m+2)^{th}$ gamma selector, as an $(n+p+q)^{th}$ gradation voltage. Values of p and q may vary according in different embodiments.

The gradation division unit DIV_gradation generates the $2^{nd}$ gradation voltage V<1> to the $255^{th}$ gradation voltage V<254> by the voltage distribution between the $1^{st}$ gamma voltage GV1 to the 11th gamma voltage GV11. Specifically, the gradation division unit DIV_gradation generates an $(n+1)^{th}$ gradation voltage to an $(n+p-1)^{th}$ gradation voltage by the voltage distribution between the $n^{th}$ gradation voltage and the $(n+p)^{th}$ gradation voltage and generates an $(n+p+1)^{th}$ gradation voltage to an $(n+p+q-1)^{th}$ gradation voltage by the voltage distribution between the $(n+p)^{th}$ gradation voltage and the $(n+p+q)^{th}$ gradation voltage. For example, in FIG. 7, the gradation division unit DIV_gradation generates the $3^{rd}$ gradation voltage V<2> to the $5^{th}$ gradation voltage V<4> between the voltage distribution between the $2^{nd}$ gradation voltage V<1> and the $6^{th}$ gradation voltage V<5>. Furthermore, in FIG. 7, the gradation division unit DIV_gradation generates the $7^{th}$ gradation voltage V<6> to the $11^{th}$ gradation voltage V<10> by the voltage distribution between the 6th gradation voltage V<5> and the $12^{th}$ gradation voltage V<1>.

In FIG. 7, when an offset of each buffer is $\pm\Delta\epsilon$, the $2^{nd}$ to 255th gradation voltages V<1> to V<254> being output from the gamma control unit, which comprises the gradation buffers A1 and A13, the gamma division unit DIV_gamma, the gamma selectors GM1 to GM11, the gamma buffers A2 to A12 and the gradation division unit DIV_gradation, includes the offset of $\pm 2\Delta\epsilon$ (that is, 2 stages offset). Thus, the apparatus for generating the gradation voltage of FIG. 7 is considered excellent in terms of offset, as compared to the gradation voltage generator of FIG. 4.

The gamma adjustment register GAMMA AR outputs the $1^{st}$ gamma selection signal GS1 to the $11^{th}$ gamma selection signal GS11 respectively to the gamma selector GM1 to the gamma selector GM11, through respective level shifters LS. That is, the gamma adjustment register GAMMA AR controls the selection operation of the gamma selector GM1 to the gamma selector GM11, so as to determine a gamma curve.

The apparatus for generating the gradation voltage of FIG. 7, which comprises the above-described elements, generates the $1^{st}$ gradation voltage V<0> to the $256^{th}$ gradation voltage V<255> by corresponding the maximum reference voltage V_max to the $1^{st}$ gradation voltage V<0> and corresponding the minimum reference voltage V_min to the $256^{th}$ gradation voltage V<255> in the first section. Furthermore, the apparatus for generating the gradation voltage of FIG. 7 generates the $1^{st}$ gradation voltage V<0> to the $256^{th}$ gradation voltage V<255> by corresponding the minimum reference voltage V_min to the $1^{st}$ gradation voltage V<0> and corresponding the maximum reference voltage V_max to the $256^{th}$ gradation voltage V<255> in the second section. Accordingly, the apparatus for generating the gradation voltage of FIG. 7 is capable of supporting an X-axis symmetric gamma inversion by alternately repeating the operation in the first section and the operation in the second section.

However, in FIG. 7, the $6^{th}$ gamma voltage GV6, which is output from the gamma selector GM6 to the gamma buffer A7, is not used as a gradation voltage. That is, although the gamma buffer A7 outputs a symmetric reference voltage Vcenter by buffering the $6^{th}$ gamma voltage GV6, the symmetric reference voltage Vcenter is involved with only the generation of the $97^{th}$ gradation voltage V<96> to the $160^{th}$ gradation voltage V<159>, but is not used as a gradation voltage.

If the symmetric reference voltage Vcenter is used as the $128^{th}$ gradation voltage V<127>, each of the $1^{st}$ gradation voltage to the $128^{th}$ gradation voltage and each of the $256^{th}$ gradation voltage to the $129^{th}$ gradation voltage do not satisfy the accurate X-axis symmetric interrelationship therebetween, as illustrated in the gamma curve of the graph in FIG. 3B. For an accurate X-axis symmetric interrelation, the $128.5^{th}$ gradation, among the $1^{st}$ gradation to the $256^{th}$ gradation, is to be used as the reference X-axis, instead of using the $128^{th}$ gradation as the reference X-axis. In the present invention, the voltage level of the symmetric reference voltage Vcenter corresponding to the $128.5^{th}$ gradation is used as the reference X-axis for the accurate X-axis symmetric interrelation. Unlike the gradation voltage generators of FIGS. 4 through 6, the apparatus for generating the gradation voltage according to the present embodiment as illustrated in FIG. 7 supports the accurate X-axis symmetric gamma inversion because the $128.5^{th}$ gradation is used as the reference X-axis.

The apparatus for generating the gradation voltage as illustrated in FIG. 7 generates two hundred and fifty-six (256) gradation voltages V<0> to V<255> but the present invention is not limited thereto and thus the apparatus can be applied to a gradation voltage generator generating 128, 512, and 1,024 gradation voltages. One skilled in the art understands that the 64 to 1 selectors MS1, MS2, and GM1 to GM11 in FIG. 7 may be replaced with 32 to 1 selectors, 128 to 1 selectors, 256 to 1 selectors and others. In FIG. 7, the 64 to 1 selectors MS1, MS2, and GM1 to GM11 are respectively controlled by the 6-bit control signals S_max, S_min, and GS1 to GS11. However, the 128 to 1 selectors may be respectively controlled by 7-bit control signals.

Figure 8:
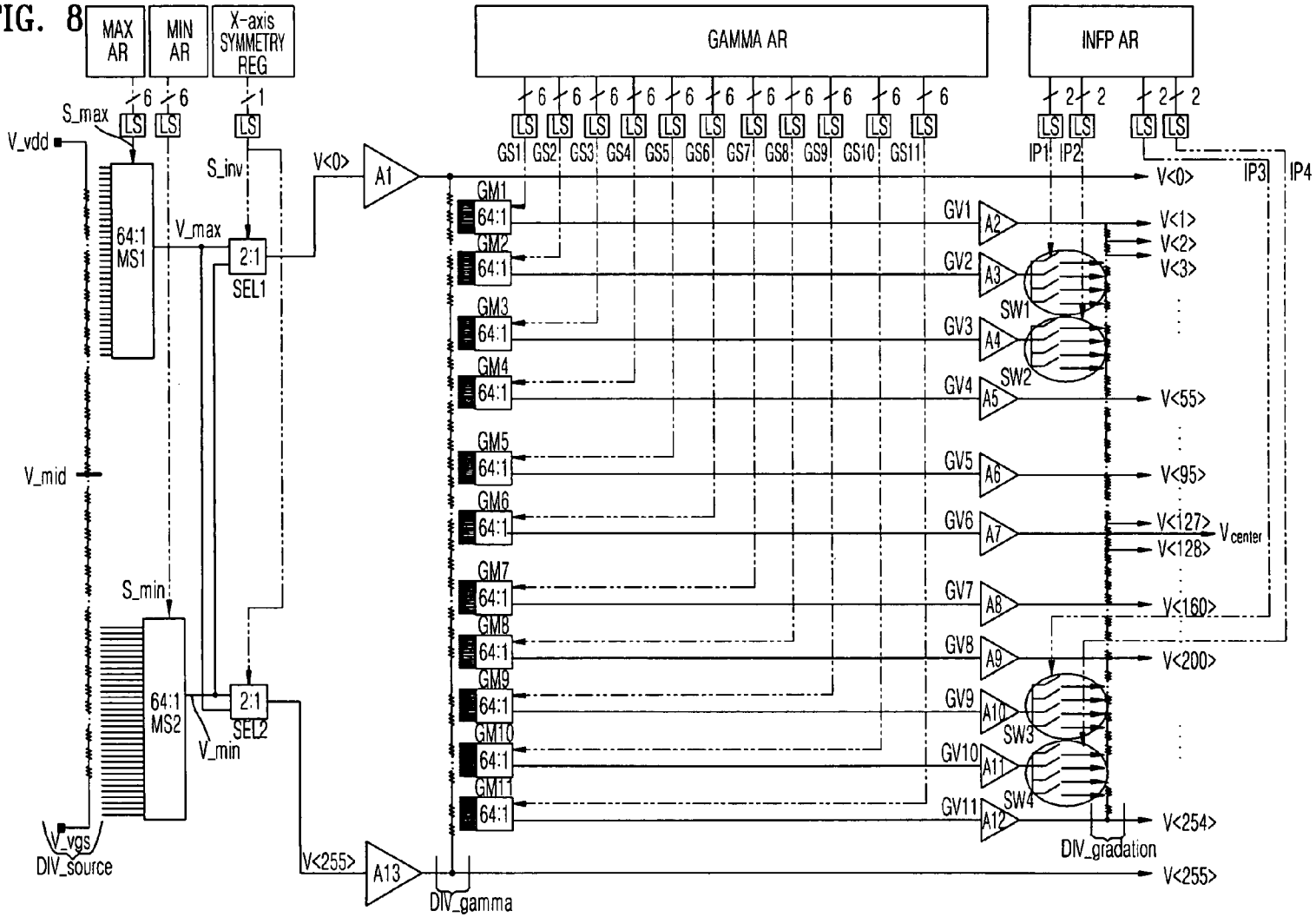
FIG. 8 illustrates an embodiment of an apparatus for generating a gradation voltage, according to another aspect of the present invention.

FIG. 8 illustrates an embodiment of an apparatus for generating a gradation voltage, according to another aspect of the present invention.

The apparatus for generating the gradation voltage as illustrated in FIG. 8 further comprises inflection point adjustment switches SW1, SW2, SW3 and SW4 and an inflection point adjustment register INFP AR, as compared to the apparatus for generating the gradation voltage of FIG. 7. The inflection point adjustment switch SW1 adjusts the connection point between the gamma buffer A3 and the gradation division unit DIV_gradation in response to an inflection point adjustment signal IP1. The inflection point adjustment switch SW2 adjusts the connection point between the gamma buffer A4 and the gradation division unit DIV_gradation in response to an inflection point adjustment signal IP2. The inflection point adjustment switch SW3 adjusts the connection point between the gamma buffer A10 and the gradation division unit DIV_gradation in response to an inflection point adjustment signal IP3. And the inflection point adjustment switch SW4 adjusts the connection point between the gamma buffer A11 and the gradation division unit DIV_gradation in response to an inflection point adjustment signal IP4. The inflection point adjustment register INFP AR outputs the inflection point adjustment signals IP1, IP2, IP3, and IP4 to the inflection point adjustment switches SW1, SW2, SW3, and SW4 through respective level shifters LS of the inflection point adjustment switches SW1, SW2, to adjust the inflection point of a corresponding gamma curve.

As described above, each display panel has its intrinsic gamma properties. When the inflection point of the gamma curve for a display panel is adjusted by using the inflection point adjustment switches SW1, SW2, SW3, and SW4 and the inflection point adjustment register INFP AR, each display panel is provided with the gamma curve that is proper for the display panel.

The apparatus for generating the gradation voltage according to aspects of the present invention is described above. However, aspects of the present invention can be understood as a method of generating a gradation voltage for X-axis symmetric gamma inversion. That is, in an embodiment of the method of generating the gradation voltage according to aspects of the present invention, the following operation is performed:

From among a plurality of voltages generated by voltage distribution between a first source voltage V_vdd and a second source voltage V_vgs, a maximum reference voltage V_max and a minimum reference voltage V_min are selected.

Subsequently, in response to an inversion control signal S_inv, the maximum reference voltage V_max is selected as a $1^{st}$ gradation voltage V<0> and the minimum reference voltage V_min is selected as an $N^{th}$ gradation voltage V<N−1> or the minimum reference voltage V_min is selected as the $1^{st}$ gradation voltage V<0> and the maximum reference voltage V_max is selected the $N^{th}$ gradation voltage V<N−1>. Specifically, when a logic level of the inversion control signal S_inv is at a first level, the maximum reference voltage V_max is selected as the $1^{st}$ gradation voltage V<0> and the minimum reference voltage V_min is selected as the $N^{th}$ gradation voltage V<N−1>. When the logic level of the inversion control signal S_inv is at a second level, the minimum reference voltage V_min is selected as the $1^{st}$ gradation voltage V<0> and the maximum reference voltage V_max is selected as the $N^{th}$ gradation voltage V<N−1>.

Subsequently, from among a plurality of voltages generated by the voltage distribution between the $1^{st}$ gradation voltage V<0> and the $N^{th}$ gradation voltage V<N−1>, a $1^{st}$ gamma voltage GV1 to an $M^{th}$ gamma voltage GVM are selected, where N and M are natural numbers.

A $2^{nd}$ gradation voltage V<1> to an $(N-1)^{th}$ gradation voltage V<N−2> are then generated using the voltage distribution between the $1^{st}$ gradation voltage V<0>, the $1^{st}$ gamma voltage GV1 to the $M^{th}$ gamma voltage GVM, and the $N^{th}$ gradation voltage V<N−1>. For example, when an $M^{th}$ gamma voltage (wherein m is 1 to M) is output as an $n^{th}$ gradation voltage (wherein n is 1 to N), an $(m+1)^{th}$ gamma voltage is output as an $(n+p)^{th}$ gradation voltage and an $(m+_2)^{th}$ gamma voltage is output as an $(n+p+q)^{th}$ gradation voltage, and an $(n+1)^{th}$ gradation voltage to an $(n+p-1)^{th}$ gradation voltage are generated by the voltage distribution between the $n^{th}$ gradation voltage and the $(n+p)^{th}$ gradation voltage. Furthermore, an $(n+p+1)^{th}$ gradation voltage to an $(n+p+q-1)^{th}$ gradation voltage are generated by the voltage distribution between the $(n+p)^{th}$ gradation voltage and the $(n+p+q)^{th}$ gradation voltage.

In FIG. 7, the voltage distribution between the $1^{st}$ gradation voltage V<0> and the $1^{st}$ gamma voltage GV1=V<1> is not performed. However, in another embodiment, the $2^{nd}$ gradation voltage and the $3^{rd}$ gradation voltage and others may be generated by additionally arranging a gradation division unit (for example, a resistor string) between an output terminal of the gradation buffer A1 and an output terminal of the gamma buffer A2 and by the voltage distribution between the $1^{st}$ gradation voltage V<0> and the $1^{st}$ gamma voltage GV1. Furthermore, the $255^{th}$ gradation voltage V<254>, the $254^{th}$ gradation voltage V<253>, and others may be generated by additionally arranging a resistor string between an output terminal of the gradation buffer A13 and an output terminal of the gamma buffer A12 and by the voltage distribution between the $256^{th}$ gradation voltage V<255> and the $11^{th}$ gamma voltage GV11.

In the present invention, since middle level between the first gradation and the N gradation is accurately used as the reference X-axis, the apparatus for generating the gradation voltage can accurately support the X-axis symmetric gamma inversion. Furthermore, the apparatus for generating the gradation voltage according to aspects of the present invention can provide a gamma curve suitable for each display panel by properly adjusting the inflection point of the gamma curve.

While the foregoing has described what are considered to be the best mode and/or other preferred embodiments, it is understood that various modifications can be made therein and that the invention or inventions can be implemented in various forms and embodiments, and that they may be applied in numerous applications, only some of which have been described herein. It is intended by the following claims to claim that which is literally described and all equivalents thereto, including all modifications and variations that fall within the scope of each claim.

What is claimed is:

1. An apparatus that generates gradation voltages, comprising:

a maximum/minimum selection unit configured to output a voltage corresponding to a maximum selection signal as a maximum reference voltage and a voltage corresponding to a minimum selection signal as a minimum reference voltage, from a distribution of voltages ranging from a first source voltage to a second source voltage, wherein the maximum reference voltage is chosen from the first source voltage to a middle voltage of the voltage distribution and the minimum reference voltage is chosen from the middle voltage to the second source voltage of the voltage distribution;

a first selector configured to output the maximum reference voltage or the minimum reference voltage as a $1^{st}$ gradation voltage, in response to an inversion control signal;

a second selector configured to output the minimum reference voltage or the maximum reference voltage as an $N^{th}$ gradation voltage, in response to the inversion control signal, where N is a natural number, wherein when the logic level of the inversion control signal is at a first level, the first selector outputs the maximum reference voltage as the $1^{st}$ gradation voltage and the second selector outputs the minimum reference voltage as the $N^{th}$ gradation voltage, and when the logic level of the inversion control signal is at a second level, the first selector outputs the minimum reference voltage as the $1^{st}$ gradation voltage and the second selector outputs the maximum reference voltage as the $N^{th}$ gradation voltage; and a gamma control unit configured to:

select, from among a plurality of voltages in a voltage distribution between the $1^{st}$ gradation voltage and the $N^{th}$ gradation voltage, voltages corresponding to a $1^{st}$ gamma selection signal to an $M^{th}$ gamma selection signal, respectively, as a $1^{st}$ gamma voltage to an $M^{th}$ gamma voltage, where M is a natural number, and generate a $2^{nd}$ gradation voltage to an $(N-1)^{th}$ gradation voltage from the $1^{st}$ gamma voltage to the $M^{th}$ gamma voltage, wherein a middle gamma voltage between the $1^{st}$ gamma voltage and the $M^{th}$ gamma voltage is used as a symmetric reference voltage, but not used as gradation voltage.

2. The apparatus of claim 1, wherein the maximum/minimum selection unit comprises:

a source division unit configured to generate a plurality of voltages from a voltage distribution ranging from the first source voltage to the second source voltage;

a maximum selector configured to output the voltage corresponding to the maximum selection signal as the maximum reference voltage, from among voltages ranging from the first source voltage to the middle voltage of the voltage distribution; and a minimum selector configured to output the voltage corresponding to the minimum selection signal as the minimum reference voltage, from among voltages ranging from the middle voltage to the second source voltage.

3. The apparatus of claim 2, further comprising:

a maximum adjustment register configured to output the maximum selection signal to the maximum selector through a first level shifter; and a minimum adjustment register configured to output the minimum selection signal to the minimum selector through a second level shifter.

4. The apparatus of claim 1, further comprising:

an X-axis symmetry register for outputting the inversion control signal to the first selector and the second selector through a level shifter.

5. The apparatus of claim 1, wherein, when a logic level of the inversion control signal is at a first level, the first selector outputs the maximum reference voltage as the $1^{st}$ gradation voltage, and the second selector outputs the minimum reference voltage as the $N^{th}$ gradation voltage.

6. The apparatus of claim 5, wherein, when a logic level of the inversion control signal is at a second level, the first selector outputs the minimum reference voltage as the $1^{st}$ gradation voltage, and the second selector outputs the maximum reference voltage as the $N^{th}$ gradation voltage.

7. The apparatus of claim 1, wherein the gamma control unit comprises:

a $1^{st}$ gradation buffer configured to buffer and output the $1^{st}$ gradation voltage output from the first selector; and a $N^{th}$ gradation buffer configured to buffer and output the $N^{th}$ gradation voltage output from the second selector.

8. The apparatus of claim 1, wherein the gamma control unit comprises:

a gamma division unit configured to generate the plurality of voltages through the voltage distribution between the $1^{st}$ gradation voltage and the $N^{th}$ gradation voltage; and $1^{st}$ to $M^{th}$ gamma selectors configured to output, from the plurality of voltages, voltages corresponding to the $1^{st}$ to $M^{th}$ gamma selection signals as $1^{st}$ to $M^{th}$ gamma voltages, respectively.

9. The apparatus of claim 8, further comprising:

a gamma adjustment register configured to output each of the $1^{st}$ gamma selection signal to the $M^{th}$ gamma selection signal to the $1^{st}$ gamma selector to the $M^{th}$ gamma selector through respective level shifters.

10. The apparatus of claim 8, wherein the gamma control unit further comprises:

$1^{st}$ to $M^{th}$ gamma buffers configured to buffer and output the $1^{st}$ to $M^{th}$ gamma voltages output from the $1^{st}$ to $M^{th}$ gamma selectors, respectively.

11. The apparatus of claim 10, wherein the gamma control unit further comprises:

a gradation division unit configured to generate the $2^{nd}$ gradation voltage to the $(N-1)^{th}$ gradation voltage through a voltage distribution between the $1^{st}$ gamma voltage to the $M^{th}$ gamma voltage.

12. The apparatus of claim 11, wherein an $m^{th}$ gamma buffer outputs an $m^{th}$ gamma voltage as an $n^{th}$ gradation voltage;

an $(m+1)^{th}$ gamma buffer outputs an $(m+1)^{th}$ gamma voltage as an $(n+p)^{th}$ gradation voltage; and an $(m+2)^{th}$ gamma buffer outputs an $(m+2)^{th}$ gamma voltage as an $(n+p+q)^{th}$ gradation voltage, where m, n, p, and q are natural numbers, and m=1 to M and n=1 to N.

13. The apparatus of claim 12, wherein the gradation division unit is configured to generate an $(n+1)^{th}$ gradation voltage to an $(n+p-1)^{th}$ gradation voltage through a voltage distribution between the $n^{th}$ gradation voltage and the $(n+p)^{th}$ gradation voltage, and to generate an $(n+p+1)^{th}$ gradation voltage to an $(n+p+q-1)^{th}$ gradation voltage through a voltage distribution between the $(n+p)^{th}$ gradation voltage and the $(n+p+q)^{th}$ gradation voltage.

14. The apparatus of claim 12, wherein an $$\left(\frac{M+1}{2}\right)^{th}$$

gamma voltage being output from an $$\left(\frac{M+1}{2}\right)^{th}$$

gamma selector to an $$\left(\frac{M+1}{2}\right)^{th}$$

gamma buffer is not used as the gradation voltage.

15. The apparatus of claim 11, wherein the gamma control unit further comprises:

an inflection point adjustment switch configured to adjust a connection point between an $m^{th}$ gamma buffer and the gradation division unit, in response to an inflection point adjustment signal, where m is a natural number that equals 1 to M.

16. The apparatus of claim 15, further comprising:

an inflection point adjustment register configured to output the inflection point adjustment signal to the inflection point adjustment switch through a level shifter.

17. A method of generating a gradation voltage, comprising:

selecting a maximum reference voltage and a minimum reference voltage, from a distribution of voltages ranging from a first source voltage to a second source voltage, including choosing the maximum reference voltage from the first source voltage to a middle voltage of the voltage distribution and the minimum reference voltage chosen from the middle voltage to the second source voltage of the voltage distribution the first voltage from the first source voltage to a middle voltage of the voltage distribution and choosing the second source voltage from the middle voltage to a second source voltage of the voltage distribution;

selecting the maximum reference voltage as a $1^{st}$ gradation voltage and the minimum reference voltage as an $N^{th}$ gradation voltage in response to an inversion control signal, or selecting the minimum reference voltage as the $1^{st}$ gradation voltage and the maximum reference voltage as the $N^{th}$ gradation voltage, in response to the inversion control signal, where N is a natural number, wherein when the logic level of the inversion control signal is at a first level, the first selector outputs the maximum reference voltage as the $1^{st}$ gradation voltage and the second selector outputs the minimum reference voltage as the $N^{th}$ gradation voltage, and when the logic level of the inversion control signal is at a second level, the first selector outputs the minimum reference voltage as the $1^{st}$ gradation voltage and the second selector outputs the maximum reference voltage as the $N^{th}$ gradation voltage;

selecting a $1^{st}$ gamma voltage to an $M^{th}$ gamma voltage, from among a plurality of voltages in a voltage distribution between the $1^{st}$ gradation voltage and the $N^{th}$ gradation voltage, where M is a natural number; and generating a $2^{nd}$ gradation voltage to an $(N-1)^{th}$ gradation voltage by a voltage distribution between the $1^{st}$ gradation voltage, the $1^{st}$ gamma voltage to the $M^{th}$ gamma voltage, and the $N^{th}$ gradation voltage, including using a middle gamma voltage between the 1st gamma voltage and the $M^{th}$ gamma voltage as symmetric reference voltage, but not as gradation voltage.

18. The method of claim 17, wherein, when a logic level of the inversion control signal is at a first level, the maximum reference voltage is selected as the $1^{st}$ gradation voltage and the minimum reference voltage is selected as the $N^{th}$ gradation voltage.

19. The method of claim 18, wherein, when a logic level of the inversion control signal is at a second level, the minimum reference voltage is selected as the $1^{st}$ gradation voltage and the maximum reference voltage is selected as the $N^{th}$ gradation voltage.

20. The method of claim 17, wherein, when an $m^{th}$ gamma voltage is output as an $n^{th}$ gradation voltage and an $(m+1)^{th}$ gamma voltage is output as an $(n+p)^{th}$ gradation voltage and an $(m+2)^{th}$ gamma voltage is output as an $(n+p+q)^{th}$ gradation voltage, an $(n+1)^{th}$ gradation voltage to an $(n+p-1)^{th}$ gradation voltage are generated through a voltage distribution between the $n^{th}$ gradation voltage and the $(n+p)^{th}$ gradation voltage, and an $(n+p+1)^{th}$ gradation voltage to an $(n+p+q-1)^{th}$ gradation voltage are generated through a voltage distribution between the $(n+p)^{th}$ gradation voltage and the $(n+p+q)^{th}$ gradation voltage, where m, n, p, and q are natural numbers and m=1 to M and n=1 to N.

* * * * *